US005794933A

United States Patent [19]

Chalfin et al.

[11] Patent Number: 5,794,933

[45] Date of Patent: Aug. 18, 1998

[54] ENHANCED PLAYING CHIP FOR WORD GAMES

[76] Inventors: William Chalfin; Julia M. Chalfin, both of 1435 E. 101 St., Brooklyn, N.Y. 11236

[21] Appl. No.: 385,421

[22] Filed: Feb. 9, 1995

[51] Int. Cl.[6] ..... A63F 3/00

[52] U.S. Cl. ..... 273/272; 273/299

[58] Field of Search ..... 273/272, 292, 273/293, 296, 299, 304, 306; 446/901

[56] References Cited

U.S. PATENT DOCUMENTS

| | | | |
|---|---|---|---|
| 1,332,249 | 3/1920 | Feero | 273/299 |
| 2,072,605 | 3/1937 | Palmer | 273/299 |
| 2,585,924 | 2/1952 | Freedman et al. | 446/901 |
| 3,655,195 | 4/1972 | Bean | 273/272 |
| 4,306,724 | 12/1981 | Brzezinski et al. | 273/272 |
| 5,280,916 | 1/1994 | Gleason, Jr. | 273/304 |
| 5,282,631 | 2/1994 | Baker | 273/272 |

*Primary Examiner*—William M. Pierce
*Attorney, Agent, or Firm*—Robert W.J. Usher

[57] ABSTRACT

An enhanced playing chip for word games having two or more letters and corresponding number values thereon. The player selectively orients the playing chip to select one of the letters. Players are provided with removable and interchangeable labels to create user-defined enhanced playing chips. A combination of letters, numbers, colors and figures may be provided on the label to create a children's educational aid.

5 Claims, 2 Drawing Sheets

ENHANCED PLAYING CHIP FOR WORD GAMES

BACKGROUND OF THE INVENTION

1. Field of the Invention

The invention relates to enhanced playing chips for word games. More specifically, it relates to a playing chip having multiple values which can be defined by the players.

2. The Prior Art

Various word games such as Scrabble are known which have educational and/or entertainment value. Various children's games, for example, consist of individual letters on one side of a block. The blocks are placed together to form words. Other types of games consist of individual letters placed on square playing chips. Players take turns trying to form words from a randomly selected group of playing chips. Typically, these playing chips are placed on a crossword grid where players can use and build upon playing chips previously set onto the crossword grid during previous turns.

A substantial drawback exists in the above-mentioned games in that the letter and respective point value are pre-selected by the manufacturer. As a result, every game that is played uses the exact same set of playing chips. Another drawback exists in that players must pass their turns, particularly towards the end of the game, when only difficult consonant letters remain to be played. Accordingly, it would be desirable to provide a game where players could create a customized set of playing chips with multiple letters so that more options are provided to the players and different sets of playing chips can be used for different games.

SUMMARY OF THE INVENTION

It is, therefore, an object of the present invention to overcome the drawbacks of the prior art and to provide playing chips having multiple letters thereon.

It is a further object of the present invention to provide a game where the player can select the number and combination of letters to be placed onto the playing chips.

It is yet another object of the present invention to provide a game where players must first assemble a playing chip before it can be used.

These and other related objects are achieved according to the invention by a word game for two or more players where players alternately form words on a crossword grid to score points. The game consists of a gameboard having a crossword grid and a plurality of basic playing chips where each basic playing chip has a letter and number value thereon for placement on the crossword grid to form words. The game also includes an enhanced playing chip having a first region containing a letter and a number value, and a second region containing an alternate letter and an alternate number value. Players alternate picking playing chips and forming words on the crossword grid with the playing chips. The enhanced playing chip is placed on the crossword grid and selectively oriented to form a word with the letter from the first region or the alternate letter from the second region. The corresponding number value or alternate number value is then added to that player's score. Various versions of the game include 90 basic playing chips with 10 enhanced playing chips and 100 basic playing chips with two of those playing chips being enhanced playing chips. The enhanced playing chips may optionally consist of a blank or wildcard option in one of the regions.

The enhanced playing chip consists of a chip frame partitioned into a first region and a second region and a plurality of labels, each containing a letter and a number value. Two of the labels are disposed onto the first and second regions, respectively, to form a user-defined or customized, enhanced playing chip. The regions and labels all have a similar shape so that the labels are interchangeable with the regions. The enhanced playing chip optionally consists of a chip frame partitioned into four regions. Labels containing a letter and number value are disposed onto the four regions to create a user-defined, enhanced playing chip. The regions and labels all have a similar shape so that the labels are interchangeable with the regions.

A further object of the invention is to provide a method of playing a word game with two or more players, where players form words on a crossword grid to score points. The method includes the steps of providing a plurality of basic playing chips with each chip having a letter and number thereon and providing an enhanced playing chip with a letter, a number, an alternate letter and an alternate number thereon. The basic playing chips and the enhanced playing chips are mixed together and a pre-determined number of playing chips are distributed to each player. Players take turns forming words on the crossword grid with their pre-determined number of playing chips. The player possessing the enhanced playing chip selectively orients the chip to select either the letter or the alternate letter to form a word. Players are assigned points based on the numbers corresponding to the letters used by that player to form words. Additional playing chips, equal to the number of playing chips that they used in that turn, are distributed to the players. The steps of forming words, assigning points and distributing additional playing chips are repeated until all of the playing chips have been distributed. The player having the greatest number of points is then declared the winner.

Another game involving two or more players includes the steps of providing a plurality of basic playing chips and providing a jigsaw playing chip consisting of jigsaw playing chip pieces. The basic playing chips and the jigsaw playing chip pieces are mixed together. The basic playing chips and the jigsaw playing chip pieces are then distributed to the players. Bonus points are assigned to a player that assembles the jigsaw playing chip from the jigsaw playing chip pieces.

BRIEF DESCRIPTION OF THE DRAWINGS

Other objects and features of the present invention will become apparent from the following detailed description considered in connection with the accompanying drawings which disclose embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
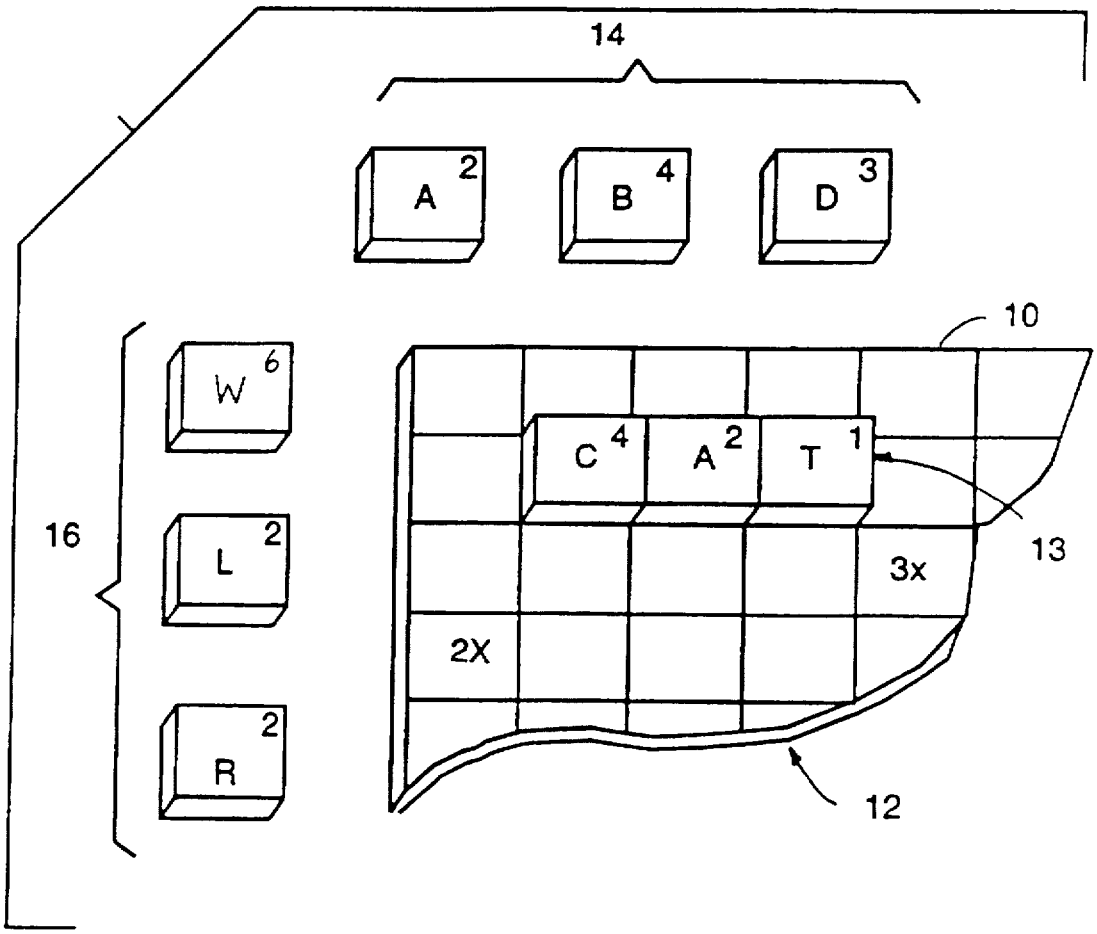
FIG. 1 is a fragmentary perspective view of a prior art game showing part of the crossword grid and various playing chips.
Figure 2A:
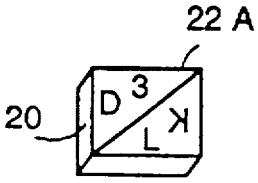
FIGS. 2A, 2B, and 2C are perspective views of an enhanced playing chip according to the invention, in three different orientations.
Figure 2B:
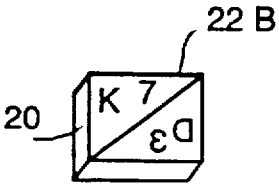

Referring now in detail to the drawings and in particular, FIGS. 1, 2A and 2B, there is shown a gameboard 10, according to the prior art, having a crossword grid 12. A word 13 is shown formed on crossword grid 12. A first set of chips 14 belonging to a first player, is used to form additional words on crossword grid 12. For example, the letters "B" and "D" can be placed on crossword grid 12 to form the word "Bad." A second player possesses a second set of chips 16 which are used to form additional words on crossword grid 12.

Figure 2C:
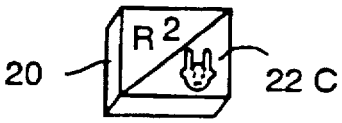

An enhanced playing chip 20 is shown having two letters and two corresponding number values thereon. A player possessing enhanced playing chip 20 may place it onto crossword grid 12 in a first orientation 22A or a second orientation 22B to select one of these two letters. In first orientation 22A, the player utilizes the letter D and scores three points. In second orientation 22B, the player utilizes the letter K and scores seven points. Chip 20 as shown in FIG. 2C may include a picture of an animal such as a rabbit, and the letter "R" to also serve as an educational toy for children.

Figure 3A:
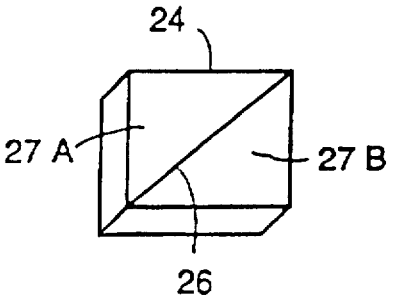
FIG. 3A is a perspective view of a partitioned chip frame according to the invention.
Figure 3B:
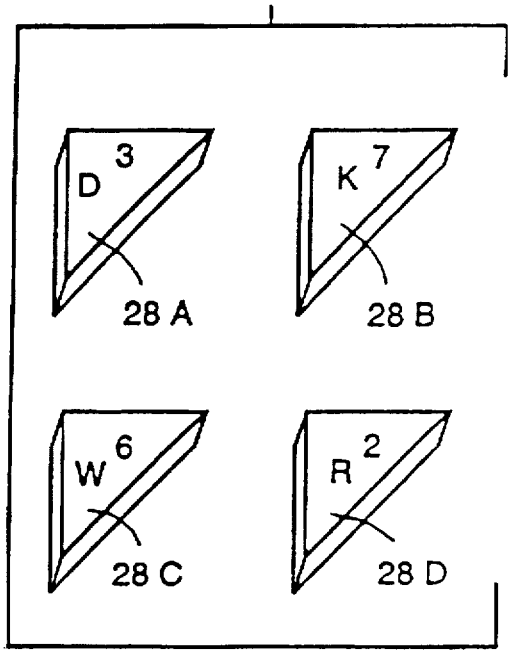
FIG. 3B is a perspective view of labels according to the invention.
Figure 3C:
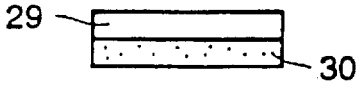
FIG. 3C is a top side elevational view of one of the labels from FIG. 3B.

Referring now to FIGS. 3A, 3B and 3C, there is shown a chip frame 24 with a partition line 26 extending across chip frame 24. Since chip frame 24 is square, partition line 26 bisects the square into two equally shaped right triangles. Chip frame 24 may be of varying shape with one or more partition lines dividing it into two or more regions. In this particular instance, chip frame 24 is divided into two regions 27A and 27B. Pressure-sensitive labels 28A, 28B, 28C and 28D are removably and interchangeably placed onto regions 27A and 27B to form user-defined enhanced playing chip, as shown in FIGS. 2A and 2B. FIG. 3C shows that each label 28A–28D consists of a paper or cardboard layer 29 with an adhesive backing 30, for example. Chip frame 24 is made of plastic or other suitable material.

Figure 4A:
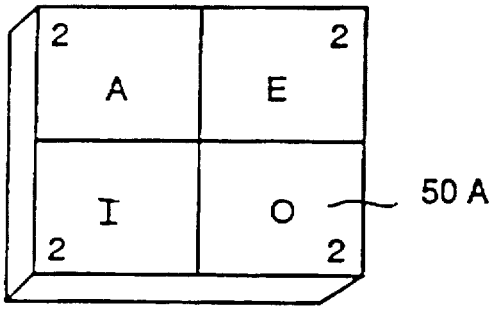
FIGS. 4A and 4B are perspective views of an enhanced playing chip with labels in various orientations.
Figure 4B:
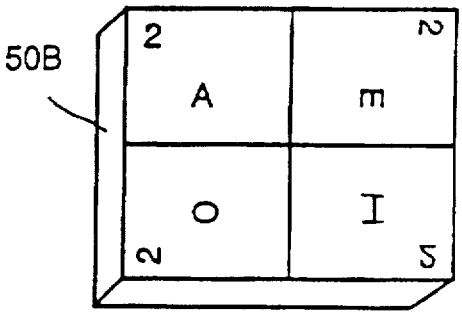

Referring now to FIGS. 4A and 4B, there is shown enhanced playing chips 50A and 50B. Enhanced playing chip 50A shows each of the labels or cards in the same orientation. Enhanced playing chip 50B shows each of the labels or cards oriented in a direction rotated 90° from adjacent labels or cards. It should be understood that playing chips 50A and 50B are merely exemplary of a variety of combinations and orientations that may be created within the scope of the invention. Although a square playing chip 50 is shown divided into four smaller square regions, a variety of other chip shapes and region shapes may be employed within the scope of this invention. For each different configuration, there may be provided pressure-sensitive labels or cards to form a multitude of user-defined enhanced playing chips.

Figure 5:
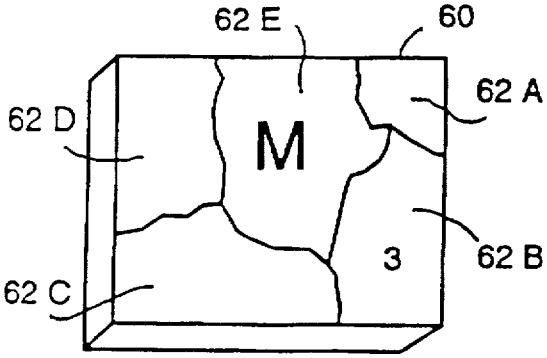
FIG. 5 is a perspective view of a jigsaw playing chip according to the invention.

Referring now to FIG. 5, there is shown a jigsaw playing chip 60 having a plurality of jigsaw playing chip pieces 62A, 62B, 62C, 62D and 62E. The playing chip pieces 62A–62E are treated as individual chips and distributed along with other whole chips. If a single player collects all chips 62A–62E and assembles the jigsaw playing chip 60, bonus points are awarded. Although a single configuration of a jigsaw playing chip 60 is shown, many others are within the scope of this invention. For example, jigsaw playing chip 60 may be divided into any number of two or more pieces. The completed jigsaw playing chip may include one or more letters, numbers or other figures thereon to provide an enhanced jigsaw playing chip.

While only a few embodiments of the present invention have been shown and described, it is to be understood that many changes and modifications may be made thereunto without departing from the spirit and scope of the invention as defined in the appended claims.

What is claimed is:

1. A word game set for playing a word game on a gameboard having a crossword grid for two or more players where players alternately form words on the crossword grid to score points, the game set comprising:

a plurality of basic playing chips, each basic playing chip having a letter and number value thereon for placement on said crossword grid to form words:

at least one enhanced playing chip comprising a chip frame partitioned into at least a first region and a second region;

a plurality of labels, each label containing a letter and a number value, wherein at least two of said labels containing different letter and number values are removably disposed onto said first and second regions, respectively, to form a user-defined, enhanced playing chip with an alternative letter and an alternative number value, wherein players may alternate picking playing chips and forming words on a crossword grid with said playing chips;

wherein said at least one enhanced playing chip may be placed on said crossword grid and selectively oriented to form a word with:

said letter from said first region with a corresponding number value being added to a player's score; and said alternate letter from said at least a second region with said corresponding alternate number value being added to a player's score.

2. The word game set according to claim 1, wherein said first region, said second region and each of said labels have a similar shape so that said labels are interchangeable with said first and second regions.

3. A word game set for playing a word game on a gameboard having a crossword grid for two or more players where players alternately form words on the crossword grid to score points, the game set comprising:

a plurality of basic playing chips, each basic playing chip having a letter and number value thereon for placement on said crossword grid to form words:

at least one enhanced playing chip comprising a chip frame partitioned into a first region, a second region, a third region and a fourth region;

a plurality of labels, each label containing a letter and a corresponding number value, wherein four of said labels containing different letter and corresponding number values are disposed onto respective first, second, third and fourth regions, to create a user-defined, enhanced playing chip with alternative letter and alternative number values, wherein players may alternate picking playing chips and forming words on a crossword grid with said playing chips;

wherein said at least one enhanced playing chip may be placed on said crossword grid and selectively oriented so that one of the letters thereof forms a word with:

said number value corresponding to the word forming letter being added to a player's score.

4. The word game set according to claim 3, wherein said first region, said second region, said third region, said fourth region and said labels all have a similar shape so that said labels are interchangeable with said regions.

5. The word game according to claim 4, wherein said plurality of labels are removable pressure-sensitive labels.

* * * * *